United States Patent [19]

Kroenke

[11] 4,335,533

[45] Jun. 22, 1982

[54] CUSHIONED NEEDLEWORK BLOCKING BOARD

[76] Inventor: June E. Kroenke, 2199A Scenic Rd., Richfield, Wis. 53076

[21] Appl. No.: 128,769

[22] Filed: Mar. 10, 1980

[51] Int. Cl.[3] ..... D06F 71/32; A41H 5/00

[52] U.S. Cl. ..... 38/141; 223/69

[58] Field of Search ..... 38/102, 102.1, 102.91, 38/103, 137, 141, 144, 140; 223/69

[56] References Cited

U.S. PATENT DOCUMENTS

| | | | |
|---|---|---|---|
| 2,142,767 | 1/1939 | Stemm | 38/144 X |
| 2,160,337 | 5/1939 | McKee | 38/141 |
| 2,714,978 | 8/1955 | Smith | 223/69 |
| 3,414,995 | 12/1968 | Adiletta et al. | 38/140 |
| 3,473,245 | 10/1969 | Baily et al. | 38/141 |
| 3,477,155 | 11/1969 | Feld et al. | 223/69 X |
| 3,486,668 | 12/1969 | Feld et al. | 223/69 |
| 4,026,445 | 5/1977 | Poage | 223/69 |

FOREIGN PATENT DOCUMENTS

| | | | |
|---|---|---|---|
| 179743 | 12/1935 | Switzerland | 223/69 |

*Primary Examiner*—Louis Rimrodt

*Attorney, Agent, or Firm*—Andrus, Sceales, Starke & Sawall

[57] ABSTRACT

A needlework blocking apparatus includes an inner continuous board of a pressed fiber board or the like, which readily receives and holds conventional straight pins, headed-tacks or the like. An outer cover enclosure unit includes front and back wall covers which are interconnected along the perimeter by conventional sewing. The one cover is imprinted with blocking indicia including concentric squares and circles of different sizes as well as radial lines for proper locating of the needlepoint piece. The covers are formed of a napped 100° cotton fabric for absorbing and holding sufficient moisture required for professional pressing and blocking needlework. A crush-proof inner cushion pad of polyurethene foam is bonded to the inner surface of the napped cotton working cover to define a soft cushioned working surface. The needlework piece is secured with the finished face abutting the soft cushioned working surface. Where desired, a wet pressing cloth is placed over the affixed piece and an iron moved thereover.

1 Claim, 4 Drawing Figures

CUSHIONED NEEDLEWORK BLOCKING BOARD

BACKGROUND OF THE PRESENT INVENTION

This application relates to a cloth blocking apparatus for the blocking of various forms of needlework.

Various forms of needlework are done by individuals. The needlework may use different thread-like elements which will be readily recognized by those involved in needlecraft, and generally include needlepoint, crewel, embroidery, knitting and crochet. Most types of needlework involve the application of a cloth thread in various stitches within the warp of a woven support or base fabric. After stitching in the design, the base fabric is stretched in a planar manner to straighten and smooth out the fabric and the stitched design to thereby present and locate the design in the desired symmetrical manner. Such blocking of needlework is often professionally done because of the skill required and tedious task created. Further, although home blocking frames are available, they generally are difficult to employ. For example, a wooden frame may be provided which has adjustable connections to permit varying the perimeter or diameters. Tie elements are provided for interconnection of the edges of the supporting fabric. Another blocking frame unit available is a peg-board type structure. The stitched article is often wetted and pressed for optimum final setting of the fabric. Generally, the available devices are not adapted to such final finishing.

Although various blocking devices have been suggested, there is a distinct need for a readily used universal blocking apparatus for the various types of needlework and which will permit complete professional processing the needlework.

The present invention is particularly directed to a versatile needlework blocking apparatus adapted to the blocking and/or pressing of all the various types and forms of needlework to produce a professional finished result in a simple and reliable procedure without the necessity of any undue technical ability.

SUMMARY OF THE PRESENT INVENTION

Generally in accordance with the present invention, the blocking unit includes a rigid backing board which is formed of a continuous material of sufficient porsity to adapt the board to receive suitable tacks, pins or like attachment means and an outer cushioned cover including an outer moisture absorbing fabric cover and an interposed resilient inner pad to form a cushioned supporting surface. The cover and inner pad are intimately bonded to each other and affixed to the one surface of the board for optimum results. The fabric cover is provided with various locating indicia to permit accurate location of the various sizes and shapes of needlework which are to be pressed, blocked and/or pressed.

More particularly, in accordance with a particularly unique and practical embodiment of the present invention, the blocking unit includes an inner continuous board of a pressed fiber board or the like, which readily receives and holds pin-like elements, such as a conventional straight pin, a headed-tack or the like. The outer cover unit includes front and back fabric wall covers which closely and completely encloses the board and which may be interconnected along the perimeter by conventional sewing. The front wall or cover forms a main blocking surface and is formed of a napped 100° cotton fabric or other like woven material which provides an effective medium for absorbing and holding sufficient moisture required for professional pressing and blocking needlework. A crushproof inner cushion pad, preferably formed of a sheet of polyurethane foam, is bonded to the inner surface of the napped cotton cover and conjointly with the front cover defines a soft cushioned surface to which the unblocked needlework is to be applied. The napped cushioned cover is imprinted with suitable indicia such as a series of rectangular outline of progressively different sizes as well as similar circles outlines and radius lines. The indicia defines the basic shapes corresponding to the basic needlework normally encountered in practical retail field. The needlework fabric may be readily attached using pins or other tack-like elements. In use, the needlework fabric is stretched over and secured along its flap-edges with the finished face abutting the cushioned cover. The needlework is suitably processed, generally with suitable wetting and a conventional steam iron to provide a professionally finished needlework product. Thereafter, the tacks and/or pins are easily removed and the blocked needlework removed. The result will be found to be a professionally finished blocked piece of needlework. The finished side of the stitched thread on the cushioned face or surface allows them to move into the soft padded surface without crushing or flattening the stitches while permitting the reorientation thereof into a straight and smooth pattern.

The present invention provides a simple and effective blocking apparatus which can be used by the skilled and unskilled needleworker to produce a professionally finished product at a minimal cost.

DESCRIPTION OF THE DRAWING FIGURES

The drawing furnished herewith illustrates a preferred construction of the present invention in which the above advantages and features are clearly disclosed as well as others which will be readily understood from the following description.

BRIEF DESCRIPTION OF THE ILLUSTRATED EMBODIMENT

Figure 2:
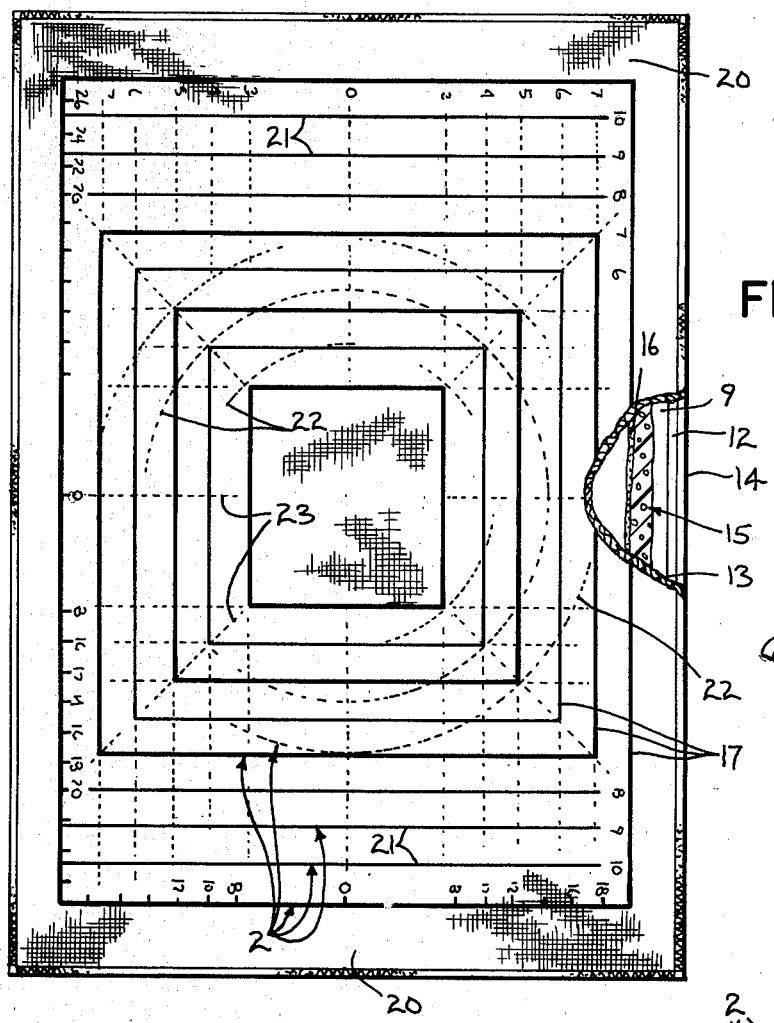
FIG. 2 is an enlarged view, similar to FIG. 1, illustrating the blocking unit.
Figure 4:
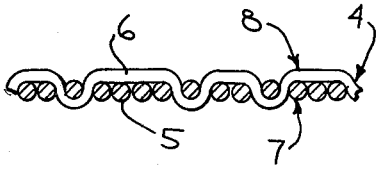
Figure 3:
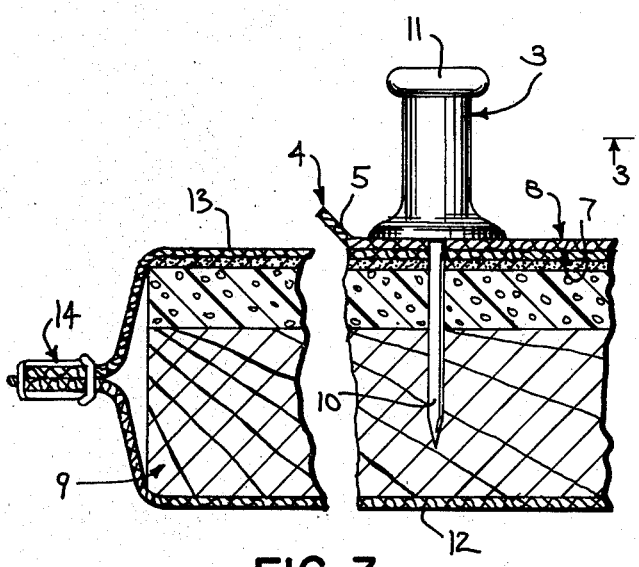
FIG. 3 is an enlarged fragmentary cross-sectional view illustrating the construction of the illustrated blocking unit including suitable tacks for firmly affixing the needlework in place.
Figure 1:
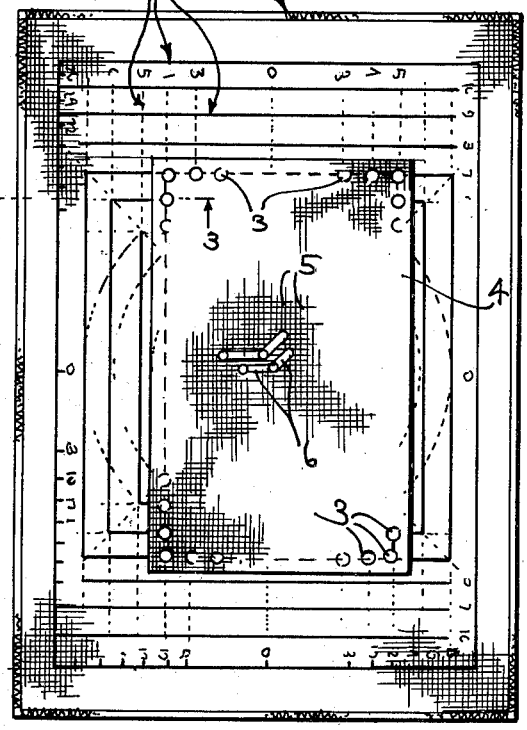
FIG. 1 is a plan view of a blocking unit illustrating one embodiment of the present invention with a needlework in place.

Referring to the drawing and particularly to FIGS. 1 and 2, the blocking unit 1 is shown as a rectangular planar rectangular member having an outer blocking face which is provided with locating indicia 2. Pin or tack elements 3 are used for releasable attachment of a needlework 4 to the blocking face with accurate location thereof and to its correct measurements within the indicia. The needlework 4 includes a woven support 5 within which a thread-like stitching 6 is woven by the needleworker. The needlework 4 generally has an outer finished side 7 and a connecting underside 8.

More particularly, in the illustrated embodiment of the invention, the blocking unit 1 includes an inner supporting board 9 which defines a relatively rigid base or support. The board 9 is formed of a material to present an outer mounting side of material which is adapted to receive and firmly hold the pins and tacks 3. The board 9 is illustrated as a single material element formed of a suitable pressed fiber or paper board which is sufficiently soft and porous to receive and hold pin-like elements. Other single layer or combinations including layered material may of course be provided as long as an appropriate outer holding layer is presented. Although the board 9 firmly holds the pin-like element 3, the material permits ready, convenient manual insertion and removal. The pins 3 may be a conventional straight stack pin, or special tacks 3 which have a pin-like shank 10 and enlarged head 11 for convenience of manipulation.

The board 9 is encased within outer cover unit including a backwall cover 12 of any suitable construction and a front working cover 13 which is particularly constructed with imprinted indicia 2 and specially constructed for use in the needlework blocking unit 1. The covers 12 and 13 are preferably formed of similar fabric and interconnected by a sewed edge seam 14 to define a form fitting cover over the support board 9. More particularly, the front working cover 13 is selected to provide a pressing surface and includes an resilient pad 15 to define a soft supporting cushioned surface for the needlework. The resilient pad 15 is selected to withstand the hot environment created during the pressing and the moisture introduced during shaping or pressing.

In a preferred construction of the present invention, a napped 100° cotton is selected for the outer working cover 9. The 100° cotton cover 13 is preferred because of its excellent moisture absorbing quality as well as providing an excellent pressing surface for the stitching material 6 employed in needlework 4. The blocking pad 15 is formed of a polyurethene foam which is firmly affixed to the back side of the cover, such as by adhesive lamination 16, shown generally enlarged for clarity of illustration. The polyurethene foam provides a long life element which does not break down under the moisture and heat conditions normally encountered in the blocking and pressing of the needlework, although one other suitable material may be used.

The cushioning pad 15 is preferably firmly laminated to the cloth cover so as to avoid possible shifting therebetween and particularly bunching of the pad material. It has been found that in order to obtain fully professional results that the needlework should be placed on a soft, smooth, cushioned surface.

Although the indicia 2 may of course by in any desired configurations, the illustrated combination of indicia 2 has been found to be highly satisfactory presentation necessary for universal blocking problems. In the illustrated embodiment, a plurality of progressively increasing size square outlines 18 are imprinted on the front face of the rectangular cover 13. The square outlines 18 are centrally located on the rectangular unit with a small border 19 at each side of the board. The opposite extended free edges 20 of the rectangular configuration includes a series of additional straight lines 21 for blocking of large rectangular needlework pieces. Additionally, a plurality of circles 22 are imprinted on the central portion of the front cover, preferably with a different form of imprinting such as by a series of dots. Various radial locating lines 23 are also preferably imprinted radiating outwardly from the edges of the inner square, as shown, or otherwise such as from the center of the unit to accommodate other configurations, such as oval-shaped needlework pieces and the like.

The illustrated embodiment of the invention with the relatively thick crushed-proof inner pad 15 bonded to the napped 100° cotton cover 13 encasing a tacking pressed board 9 has been found to provide an unusually satisfactory needlework blocking apparatus. Delicate needlework stitching can be mounted to the blocking unit 1 for straightening and/or pressing without being flattened or crushed in the process. Further, the cotton cover provides the ability of holding ample moisture for developing professionally finished results. The ruled markings of course permits the convenient and accurate placement of the work to its correct measurements in the stretched or blocked position. Tacks and pins are readily and manually inserted and removed while operating to securely hold the needlework 4 in place.

The procedure followed may of course vary with the particular needlework involved. If needlepoint is employed, the needlepoint piece is placed facedown on the cover 13 with the outline preferably centered thereon. Any one edge such as an edge 25, is securely attached to the board by a series of tacks or pins 3. Generally the tacks are located no more than one inch apart and approximately one inch from within the base fabric 5 edge. The needlepoint base fabric 5 is pulled straight, lengthwise and crosswise, with the other edges similarly secured in place by tacks 3. A conventional cotton press cloth, not shown, such as those readily available are then wetted with a conventional water mixture, such as two tablespoons of white vinegar to one cup of cold water. The wetted cotton cloth should be thoroughly wetted but not so wet to be sopping or dripping wet. The wetted cloth is located over the needlepoint and heated by moving conventional steam iron slightly above the pressing cloth. The iron should be moved slowly over the entire area until the pressed cloth is barely damp, but not totally dry. Heating in accordance with the step should be repeated until the needlework is evenly and thoroughly wetted but again not saturated. The needlepoint is then allowed to remain in position for air drying in any suitable warm dry place, such as normal room temperature. Normally, 24 to 48 hours will be found satisfactorily.

An embroidery or crewel piece which is to be straightened, can be treated in the same manner as needlepoint. If the embroidery or crewel piece is not to be straightened, the piece is simply placed wrong side up on the cushioned surface and then pressed, using a steam iron on a dry cotton press cloth or dry iron on a damp cloth. Generally, the iron is preferably held just slightly above the press cloth and moved slowly over the work area, at least in those areas in which the embroidery stitching exists. The outside areas where embroidery stitching does not exist, can be pressed in a conventional manner using a light lift and lower motion.

Knitting and crocheting will be similarly treated by laying each piece, wrong side up, on the cushioned needlework blocker, and pinned in place. With such pieces, the pins are more closely spaced, generally one quarter to one half inch. A wetted cotton press cloth, again thoroughly wetted but not saturated, is placed over the piece. The cover piece is steamed by moving of the iron slightly above the pressed cloth until the pressed cloth is barely damp but not dried. The piece is then left on the board until the piece is completely dried.

The above procedures may of course be varied as desired and are given merely as examples.

The illustrated and described embodiment has been found to produce a practical universal blocking apparatus for home use to provide professional blocking results. The structure is relatively simple and readily produced with available materials. Various modifications may of course be made within the scope of the invention which is particularly directed to combination of the cushioned and moisture absorbing working surface and the tack-like receiving support board.

Various modes in carrying out the invention are contemplated as being within the scope of the following claims, particularly pointing out and distinctly claiming the subject matter which is regarded as the invention.

I claim:

1. A needlework blocking apparatus for blocking of needlework including a base fabric with an interwoven stitched threading, comprising a base board formed of a pressed fibrous material to releasably receive and hold a sharp pin-like element, an outer surface cover for such board, such cover being formed of a napped 100 percent woven cotton cloth and being moisture-absorbing and a resilient polyurethane foam pad bonded throughout its interface to said fabric and located between said board and said fabric, said cover being provided with needlework blocking indicia, a series of rectangular blocking patterns and a series of spaced circular blocking patterns for locating a needlework piece upon said cover with the piece adapted to be releasably affixed in position upon said cover by a plurality of said pin-like elements, and a back fabric cover wall secured to said moisture-absorbing fabric about the periphery of said board to enclose the board and present a fabric surface to the back side of the blocking apparatus.

* * * * *